US006129236A

United States Patent [19]

Osokin et al.

[11] Patent Number: 6,129,236

[45] Date of Patent: Oct. 10, 2000

[54] TANK FOR THE LIQUID STORAGE AND EXPULSION

[75] Inventors: Mikhail Ivanovich Osokin, Moscow; Valery Pavlovich Soloviev, Moskovskaya oblast; Matvei Mikhailovich Makarov, Moskovskaya oblast; Valentin Georgievich Polushin, Moskovskaya oblast; Alexandr Antonovich Baboshin, Moskovskaya oblast, all of Russian Federation

[73] Assignee: Otkrytoe Aktsionernoe Obschestvo Nauchno-Proizvodstvennoe Obiedinenie "Energomash" Imeni Akademika V.P. Glushko, Moskovskaya oblast, Russian Federation

[21] Appl. No.: 09/388,798

[22] Filed: Sep. 2, 1999

[30] Foreign Application Priority Data

Feb. 23, 1999 [RU] Russian Federation ..... 99103516

[51] Int. Cl.[7] ..... B67D 5/42

[52] U.S. Cl. ..... 220/723; 222/386.5

[58] Field of Search ..... 220/720, 721, 220/722, 723; 222/386.5, 386

[56] References Cited

U.S. PATENT DOCUMENTS

| | | | |
|---|---|---|---|
| 2,880,759 | 4/1959 | Wisman | 220/723 |
| 3,750,367 | 8/1973 | Mitchell et al. | 220/723 |
| 4,117,866 | 10/1978 | Böhm et al. | 138/30 |
| 4,335,751 | 6/1982 | Sugimura et al. | 138/30 |
| 4,364,416 | 12/1982 | Jaco Bellis et al. | 220/723 |
| 4,763,805 | 8/1988 | Strock | 220/723 |
| 4,817,830 | 4/1989 | Yavorsky | 220/723 |
| 5,176,178 | 1/1993 | Schurter et al. | 220/723 |
| 5,190,184 | 3/1993 | Lechner | 220/723 |

*Primary Examiner*—Joseph M. Moy
*Attorney, Agent, or Firm*—Christie, Parker & Hale, LLP

[57] ABSTRACT

A tank comprises a structural envelope made in a form of hemisphere with a tube connection having a ring groove in its surface. A tightening ring of the structural envelope. An elastic diaphragm made in a form of hemisphere integrated with a cylinder provided with an end projection that fits into the ring groove. A bottom is made in a form of a sphere part. A thin-walled ring with a shoulder is introduced that is mounted between the tightening ring and elastic diaphragm in the place of its end projection location. The tube flange is provided with an end projection. The tightening ring is equipped with a lateral flange providing a possibility for the thin-walled ring shoulder tightening by it to the ring projection of the tube flange. The external surface of the tightening ring and internal surface of the tube flange are made tapered in the direction from the ring groove to the hemisphere of the structural envelope above the ring groove. The bottom is made to be hollow and its' internal surface is provided with holes. A splitter is introduced that is mounted in the bottom space.

7 Claims, 3 Drawing Sheets

TANK FOR THE LIQUID STORAGE AND EXPULSION

The invention relates to the field of machine building, and more particularly concerns devices comprising a pneumohydraulic reservoir with elastic separating diaphragm, designed for the liquid storage providing the possibility for its expulsion by the gas pressure, and may be used for expulsing the starting fuel when starting the liquid-propellant rocket engine.

Pneumohydraulic reservoirs are known that comprise a hemispherical structural envelope with a connection for filling and discharging the liquid, that is leak-proof connected to a spherical bottom provided with a connection for feeding the control gas and a hemispherical elastic diaphragm, the base of which has a cylinder part tightened up and fastened on the wall of hemispherical structural envelope (U.S., Pat. No. 4,117,866, C1. 138–130, 1978, or U.S., Pat. No. 4,335,751, C1. 138–130, 1982).

In one of these known designs the diaphragm cylinder part is tightened to the tank body by the coaxially located metal rings, and in another case—due to providing the diaphragm end part with a ring projection that fits into a ring groove in the tank body and by using the tightening shaped ring.

The most close to the proposed invention in its general essential features and engineering essence is a tank for the liquid storage and expulsion comprising a structural envelope made in a form of hemisphere and integrated by its end with the end of tube flange located along the longitudinal axis of hemisphere and having a ring groove in its internal surface, a connection for liquid fill and release that is mounted in the structural envelope, a tightening ring located coaxially with the longitudinal axis of the structural envelope, an elastic diaphragm fastened between the tube flange and the tightening ring that is made in a form of hemisphere integrated with a cylinder with an end projection made on the external surface of its base that fits into the ring groove of the tube flange, the external surface of the tightening ring and internal surface of the tube flange having a form of a cylinder in the places of location of the end projection and the ring groove, a bottom made in a form of a part of a sphere providing a possibility for its end influence upon the end of the tightening ring and leak-proof connection to the tube flange of the structural envelope, and a connection for feeding the control gas mounted in the bottom (U.S. Pat. No. , 4,335,751, C1. 138–30, 1982).

The main disadvantage of the known devices, the above closest including, is in the underdeveloped design of the places in which the flexible diaphragm is fastened to the structural envelope. This results in the reduced operation lifetime for the device in general. The devices are not reliable in the case of operation under high pressure (150–250 kgf/cm$^2$) because it is impossible to reach the required reduction force for the peripheral part of the diaphragm. Besides, in the known devices the diaphragm pulling proceeds during the tank draining, and the end part of the diaphragm is pulled out of the mounting place as a result of this.

The object of the invention is to secure a high reliability for the device operation at high pressure (150–250 kgf/cm$^2$).

From the engineering point of view the invention results in increasing the reliability of fastening the flexible diaphragm to a structural envelope of the tank.

This is achieved according to the invention in that in the known tank for the liquid storage and expulsion comprising a structural envelope made in a form of hemisphere and integrated by its end with the end of tube flange located along the longitudinal axis of hemisphere and having a ring groove in its internal surface, a connection for filling and releasing the liquid that is mounted in the structural envelope, a tightening ring located coaxially with the longitudinal axis of the structural envelope, an elastic diaphragm fastened between the tube flange and the tightening ring and made in a form of hemisphere integrated with a cylinder by its end with an end projection made on the external surface of its base that fits into the ring groove of the tube flange, the external surface of the tightening ring and internal surface of the tube flange having a form of a cylinder in the places of location of the end projection and the ring groove, a bottom made in a form of a part of a sphere providing a possibility for its end influence upon the end of the tightening ring and leak-proof connection to the tube flange of the structural envelope, and a connection for the control gas feed mounted in the bottom, a thin-walled ring is introduced that is provided with a shoulder on the end and is mounted between the tightening ring and elastic membrane in the place of location of its end projection, said tube flange is provided with a ring projection located on the internal surface from the side of the bottom ahead of said ring groove, and said tightening ring is provided with a lateral flange from the side of a bottom to tighten the shoulder of a thin-walled ring by it to said ring projection of the tube flange, the external surface of the tightening ring and internal surface of the tube flange in the direction from the ring groove to the hemisphere of structural envelope over the ring groove are made tapered making an acute angle with the longitudinal axis of structural envelope, the bottom is made to be hollow, its internal surface is provided with holes, and a splitter is mounted in the space of the bottom in the place of location of a connection for the control gas feed.

Additional embodiments of this tank are possible in which it is advisable that:

- said acute angle of slope of said tapered surfaces of said tightening ring and said tube flange to the longitudinal axis of the structural envelope be selected within 15–30°;
- said thin-walled ring be made with longitudinal cuttings in its wall to form elastic tabs out of the wall;
- said splitter be made in a form of a plate with punched holes, the edges of which are to be fastened to the internal surface of said bottom connected to said connection for feeding the control gas;
- the internal surface of said tightening ring is curvilinear and integrated with the bottom internal surface providing a possibility for the completion of a part of the sphere of the bottom internal surface together with the internal surface of the tightening ring to a hemisphere;
- a gasket be used, said gasket is mounted ahead of said ring groove from the bottom side between the internal surface of said tube flange and external surface of the bottom integrated with a tube flange;
- a coupling nut is used for connecting said bottom and said tube flange of the structural envelope by a threaded connection with a coupling nut, the threaded connection being sealed by a weld.

The essence of the present invention will become more apparent with reference to the accompanying drawings.

Figure 1:
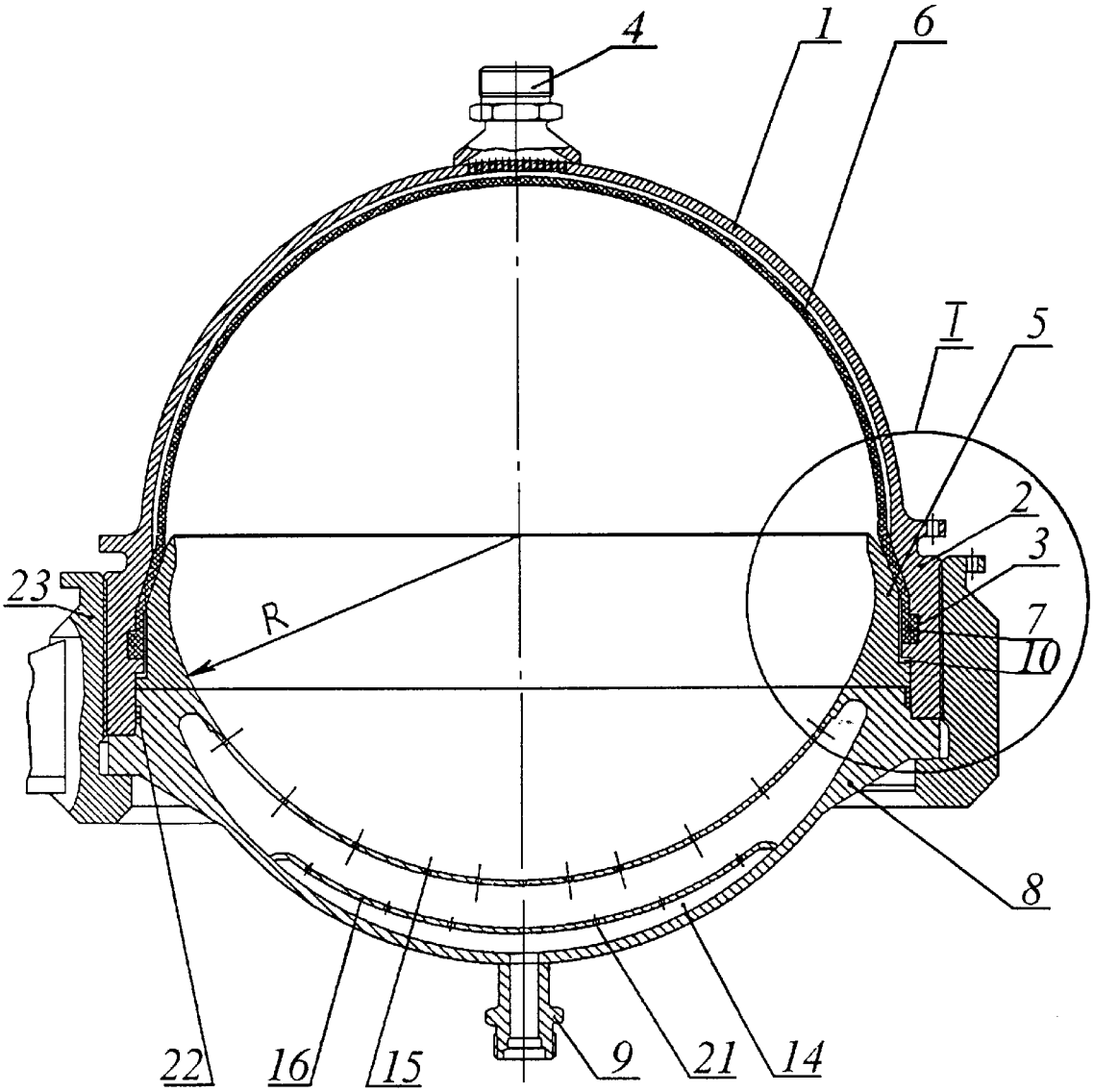
FIG. 1 is a general appearance of the tank for the liquid storage and expulsion presented as its longitudinal cross-section.

Referring to FIG. 1, a tank for the liquid storage and expulsion comprises a structural envelope 1 made in a form of hemisphere, and a tube flange 2 integrated by its end with the end of structural envelope 1. The tube flange 2 is located along the longitudinal axis of the said hemisphere of the structural envelope 1, and a ring groove 3 is made in its internal surface. The connection 4 for filling and discharging the liquid is mounted in the structural envelope 1. The tightening ring 5 is located coaxially with the longitudinal axis of the structural envelope 1. The elastic diaphragm 6 is fastened between the tube flange 2 and the tightening ring 5 and is made in a form of hemisphere integrated by its end with the cylinder provided with an end projection 7 on the external surface of its base, that fits into the ring groove 3 of the tube flange 2. The external surface of the tightening ring 5 and internal surface of the tube flange 2 are made in a form of a cylinder in the place of the end projection 7 location in the ring groove 3. The device has a bottom 8 made in a form of a part of a sphere providing a possibility for its end influence upon the end of the tightening ring 5 and leak-proof connection of the structural envelope 1 to the tube flange 2. Connection 9 for the control gas feed is mounted in the bottom 8.

A thin-walled ring 10 is introduced into the design (FIGS. 1, 2, 3, 4), that is provided with a shoulder 11 (FIGS. 2, 3, 4), and that is mounted between the tightening ring 5 and an elastic diaphragm 6 in the place of location of its ring projection 7. The tube flange 2 is provided with a ring projection 12 (FIG. 3), located on the internal surface of the tube flange 2 from the side of the bottom 8 ahead of the ring groove 3. From the side of the bottom 8 the tightening ring 5 is made with the lateral flange 13 (FIG. 3) to tighten the shoulder 11 of the thin-walled ring 10 to the ring projection 12 of the tube flange 2 by it. In the direction from the ring groove 3 to the hemisphere of the structural envelope 1 over the ring groove 3 the external surface of the tightening ring 5 and internal surface of the tube flange 2 are made tapered to form an acute angle a of slope to the longitudinal axis of the structural envelope 1. The bottom 8 (FIG. 1) is made hollow with a space 14, and its internal surface has holes 15. A splitter 16 is introduced into the space 14 of the bottom 8 in the place of location of the connection 9 for the control gas feed.

As tests showed, it is advisable to select the said acute angle a of slope of the tapered surfaces 17 and 18 (FIG. 2) of the tightening ring 5 and tube flange 2, correspondingly, to the longitudinal axis of the structural envelope 1 within the range of 15–30°.

Figure 2:
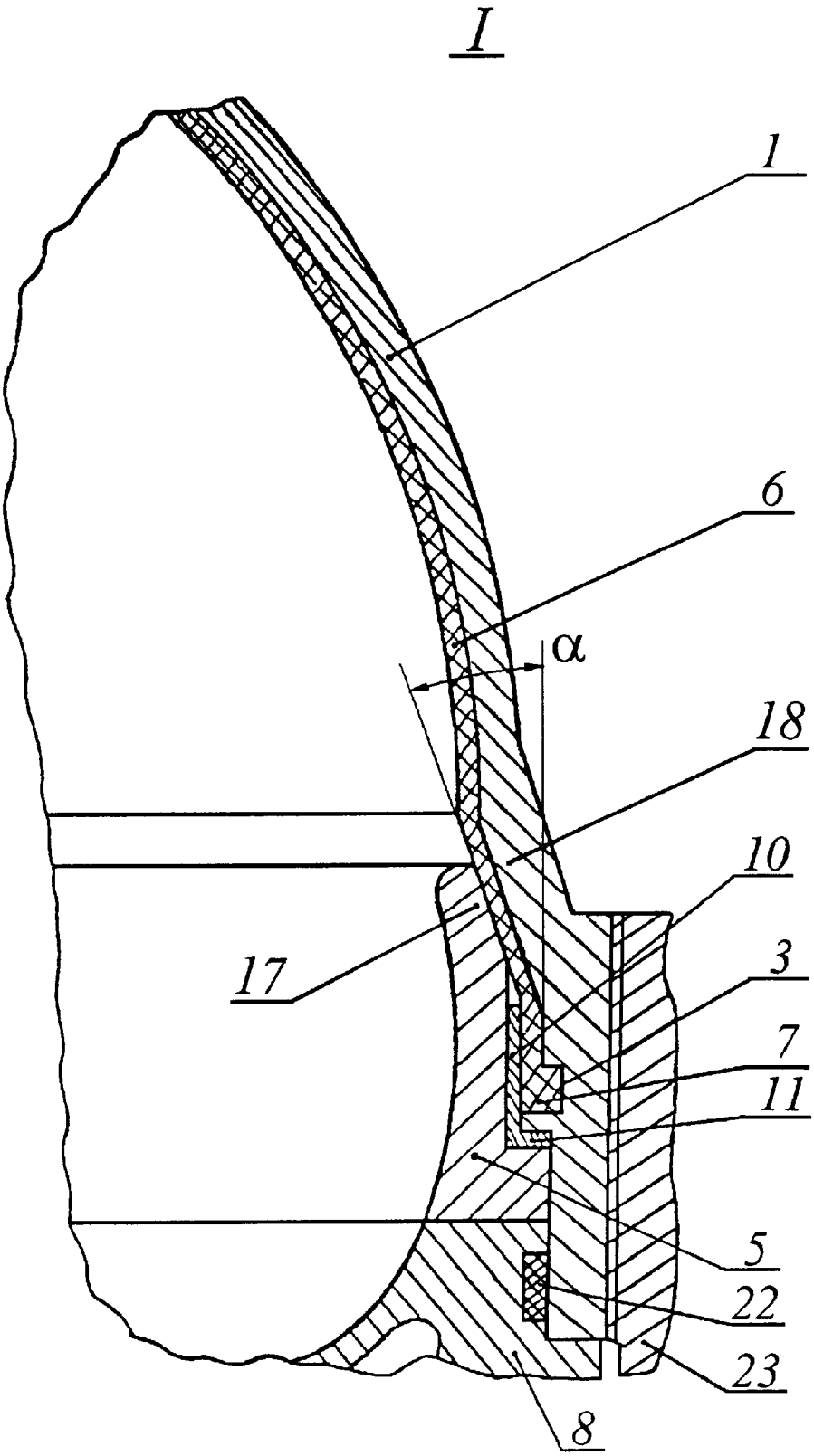
FIG. 2 is the detail I of FIG. 1 in the enlarged scale.
Figure 3:
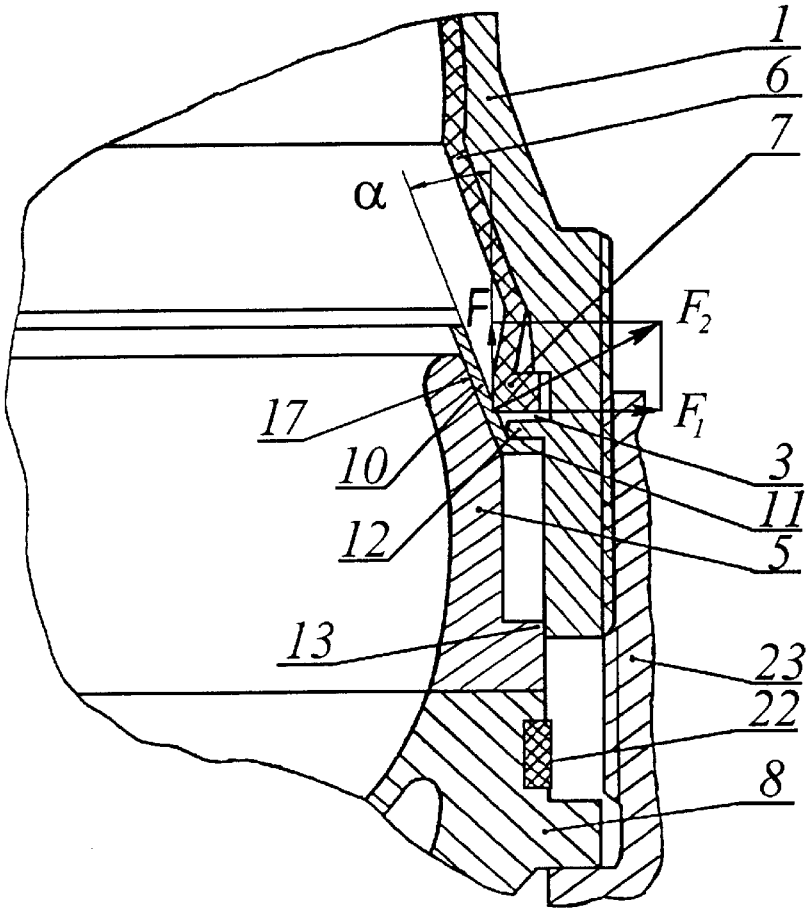
FIG. 3 is a tank attachment point with the diaphragm mounting during the assembling.
Figure 4:
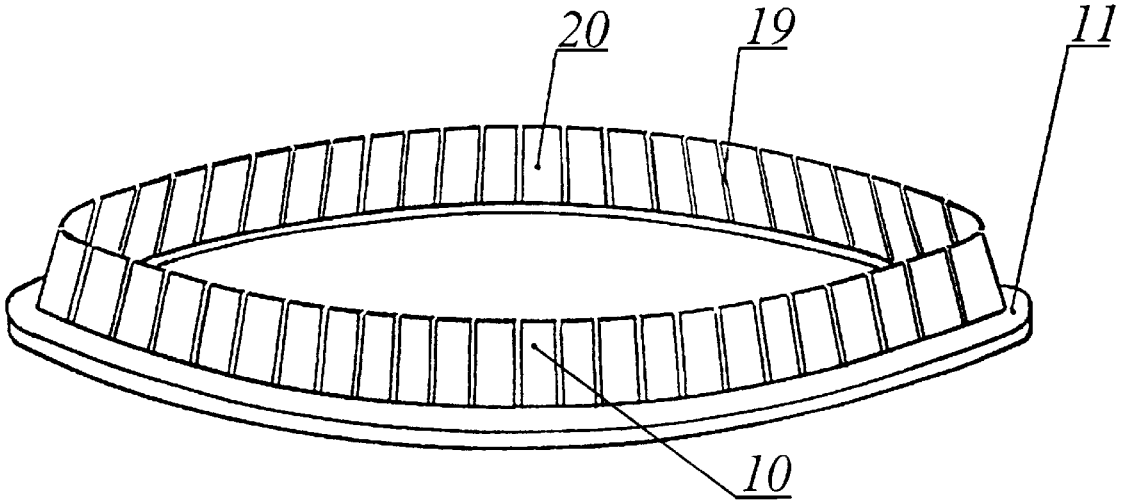
FIG. 4 is a thin-walled ring.

A thin-walled ring 10 (FIG. 4) is made with longitudinal cuttings 19 in its wall to form elastic tabs out of the wall. A thin-walled ring 10 fits into the cylinder turning in the structural envelope 1 and is loaded by the tightening ring 5 (FIGS. 1, 2, 3). Before assembling a thin-walled ring 10 is made with the angle of slope of the thin-walled ring 10 tapered surface generatrix to the longitudinal axis of the structural envelope 1 being equal to the angle of slope $\alpha$ of the tightening ring 5 tapered part generatrix. The required elastic deformation of elastic tabs 20 (FIG. 4) is reached by this and by the proper selection of material for the thin-walled ring 10.

The splitter 16 (FIG. 1) may be made in a form of a plate with perforated holes 21 the edges of which are fastened to the internal surface of the bottom 8 inside the space 14 connected to the connection 9 for the control gas feed. The splitter 16 with holes 21 is used for securing the uniform effect of the gas flow upon the elastic diaphragm 6. Other design members may be used also for splitting the control gas flow.

The internal surface of the tightening ring 5 may be made to have a curvature radius R (FIG. 1) and integrated with the internal surface of the bottom 8 providing a possibility for complementing a part of the sphere of the bottom 8 internal surface together with the internal surface of the tightening ring 5 up to a hemisphere.

A gasket 22 (FIGS. 1, 2, 3) may be used in the design for raising the quality of joints. From the side of the bottom 8 it is mounted ahead of the ring groove 3 between the internal surface of the tube flange 2 and external surface of the bottom 8 being in contact with the tube flange 2.

The bottom 8 may be connected to the structural envelope 1 by different means. In particular, at substantial pressure drops, a coupling nut 23 may be used for connecting the bottom 8 and a tube flange 2 of the structural envelope 1 by a threaded connection of the said flange 2 and a coupling nut 23. The said threaded connection may be additionally sealed by a weld.

FIG. 3 shows the assembly sequence for the tank designed for the liquid storage and expulsion.

The elastic diaphragm 6 is installed into the structural envelope 1 in such a way that the end projection 7 fits into the ring groove 3. The thin-walled ring 10 and the tightening ring 5 are mounted after that. The tightening ring 5 is inserted into the structural envelope 1 until the shoulder 11 of the thin-wailed ring 10 fits on the ring projection 12 of the tube flange 2 (FIG. 3).

The use of the thin-walled ring 10 allows to rule out the axial force F (FIG. 3) during the assembling, that seeks to pull the end projection 7 of the elastic diaphragm 6 out of the ring groove 3, and to distribute it in such a way that its effect on the end projection 7 in the axial direction is excluded substantially completely. A radial force $F_1$ is created as a result of this that occurs at the moment of contact of the tightening ring 5 and the thin-walled ring 10 and influences upon the end projection 7 of the elastic diaphragm 6.

The elastic tabs 20 of the thin-walled ring 10 are radially deformed gradually as the tightening ring 5 moves during the assembling. In this case, the end projection 7 of the elastic diaphragm 6 goes into the ring groove 3 of the tube flange 2 securing the guaranteed sealing of the elastic diaphragm 6 relative to the structural envelope 1. The presence of elastic tabs 20 decreases the force of the tightening ring 5 friction against the end projection 7 of the elastic diaphragm 6 and increases the reliability of the structure as a whole, that is especially important under the operation conditions of the elastic diaphragm 6 at multiple displacements under the conditions of high environmental pressure of up to 250 kgf/cm$^2$.

In the end position the tightening ring 5 is fixed by the end of the bottom 8 that in its turn is tightened to the structural envelope 1 by the coupling nut 23.

The device operates in the following way.

The tank is filled with the liquid through the connection 4, the elastic diaphragm 6 being displaced on the bottom 8. The control gas is fed through the connection 9 after that, by the action of which the diaphragm 6 is returned into the initial position expulsing the liquid through the connection 4.

The proposed design of the elastic diaphragm end part attachment point secures the leak-proofness at high pressure and multiple (over 450) displacements and provides an opportunity for the elastic envelope reverse bend substantially without its tension.

The propellant tank is designed for the liquid storage and expulsion, for the starting fuel of liquid-propellant rocket engines mainly. The invention may be used in the fields of engineering requiring the liquid media storage and expulsion into the corresponding hydraulic lines, in the gas and oil industry for example.

Head of Information Department (Signature) V. S. Sudakov

We claim:

1. A tank for the liquid storage and expulsion comprising:

(a) a structural envelope made in a form of hemisphere and integrated by its end with the end of tube flange located along the longitudinal axis of hemisphere and having a ring groove in its internal surface;

(b) a connection for filling and discharging the liquid that is mounted in said structural envelope, and a tightening ring located coaxially with the longitudinal axis of said structural envelope;

(c) an elastic diaphragm fastened between said tube flange and said tightening ring and made in a form of hemisphere integrated by its end with a cylinder with an end projection made on the external surface of its base that fits into the ring groove of said tube flange, the external surface of said tightening ring and internal surface of said tube flange having a form of a cylinder in the place of location of the end projection in the ring groove;

(d) a bottom made in a form of a sphere part providing a possibility for its end influence upon the end of said tightening ring and a possibility for its leak-proof connection to the tube flange of said structural envelope, and made to be hollow, while its internal surface is provided with holes;

(e) a connection for the control gas feed mounted in said bottom;

(f) a splitter mounted in the space of said bottom in the place of location of said connection for the control gas feed;

(g) a thin-walled ring that is provided with a shoulder on the end and is mounted between said tightening ring and said elastic diaphragm in the place of location of its end projection;

(h) a tube flange that is provided with a ring projection located on the internal surface of the tube flange from the side of said bottom ahead of said ring groove, and said tightening ring is provided with a lateral flange from the side of a bottom to tighten the shoulder of said thin-walled ring by it to said ring projection of the tube flange, the external surface of said tightening ring and internal surface of the tube flange in the direction from the ring groove to the hemisphere of structural envelope over the ring groove are made tapered making an acute angle with the longitudinal axis of said structural envelope.

2. A tank for the liquid storage and expulsion as set forth in claim 1, wherein said acute angle of slope of the tapered surfaces of said tightening ring and said tube flange to the longitudinal axis of the structural envelope is selected within 15–30°.

3. A tank for the liquid storage and expulsion as set forth in claim 1, wherein said thin-walled ring is made with longitudinal cuttings in its wall to form elastic tabs out of the wall.

4. A tank for the liquid storage and expulsion as set forth in claim 1, wherein said splitter is made in a form of a plate with punched holes, the edges of which are fastened to the internal surface of said bottom connected to said connection for the control gas feed.

5. A tank for the liquid storage and expulsion as set forth in claim 1, wherein the internal surface of said tightening ring is curvilinear and integrated with said bottom internal surface providing a possibility for a completion of a part of the sphere of the bottom internal surface together with the internal surface of the tightening ring to a hemisphere.

6. A tank for the liquid storage and expulsion as set forth in claim 1, wherein a gasket is used, said gasket is mounted ahead of ring groove from said bottom side between the internal surface of said tube flange and external surface of the bottom integrated with a tube flange.

7. A tank for the liquid storage and expulsion as set forth in claim 1, wherein a coupling nut is used for connecting said bottom and tube flange of said structural envelope by a threaded connection with a coupling nut, the threaded connection being sealed by a weld.

* * * * *